United States Patent [19]

Fitzgerald et al.

[11] 4,122,816

[45] Oct. 31, 1978

[54] PLASMA IGNITER FOR INTERNAL COMBUSTION ENGINE

[75] Inventors: Dennis J. Fitzgerald, Pasadena; Robert R. Breshears, La Canada, both of Calif.

[73] Assignee: The United States of America as represented by the Administrator of the National Aeronautics and Space Administration, Washington, D.C.

[21] Appl. No.: 672,636

[22] Filed: Apr. 1, 1976

[51] Int. Cl.[2] ..... F02P 1/00

[52] U.S. Cl. ..... 123/148 DC; 123/148 E; 315/209 CD; 315/209 SC; 315/241 R

[58] Field of Search ..... 315/241 R, 209 SC, 209 CD; 123/143 B, 148 R, 148 AC, 148 DC, 147, 148 E; 313/138, 128

[56] References Cited

U.S. PATENT DOCUMENTS

| | | | |
|---|---|---|---|
| 1,307,088 | 6/1919 | Drummond | 313/138 X |
| 2,864,974 | 12/1958 | Smits | 315/241 R X |
| 2,879,451 | 3/1959 | Sherwood et al. | 315/241 R X |
| 2,894,161 | 7/1959 | Sheheen | 315/241 R X |
| 3,032,683 | 5/1962 | Ruckelshaus | 315/241 R X |
| 3,515,937 | 6/1970 | Collins | 315/241 R X |
| 3,551,738 | 12/1970 | Young | 315/241 R X |
| 3,842,819 | 10/1974 | Atkins et al. | 123/191 S X |

*Primary Examiner*—Charles J. Myhre
*Assistant Examiner*—Tony M. Argenbright
*Attorney, Agent, or Firm*—Monte F. Mott; John R. Manning; Wilfred Grifka

[57] ABSTRACT

An igniter for the air/fuel mixture used in the cylinders of an internal combustion engine employs a conventional spark to initiate the discharge of a large amount of energy stored in a capacitor. A high current discharge of the energy in the capacitor switched on by a spark discharge produces a plasma and a magnetic field. The resultant combined electromagnetic current and magnetic field force accelerates the plasma deep into the combustion chamber thereby providing an improved ignition of the air/fuel mixture in the chamber.

8 Claims, 8 Drawing Figures

PLASMA IGNITER FOR INTERNAL COMBUSTION ENGINE

ORIGIN OF THE INVENTION

The invention described herein was made in the performance of work under a NASA contract and is subject to the provisions of Section 305 of the National Aeronautics and Space Act of 1958, Public Law 85-568 (72 Stat. 435; 42 USC 2457).

BACKGROUND OF THE INVENTION

This invention relates to improvements in the method and means for igniting a fuel mixture used in internal combustion engines.

At the present time there is great interest in extending the useful operating range of an internal combustion engine to much leaner combustible mixtures, where there is a potential for an increase in engine efficiency (reduced fuel consumption) and which decreases the combustion temperature thereby reducing the production and subsequent emission of Nitrous Oxides.

The conventional ignition system consists of a high voltage (low energy of approximately 0.1 joule) "spark" discharge in the combustible mixture. The "spark" ignites a small volume of the mixture which in turn spreads through the combustion chamber at the speed of the flame front.

Conventional internal combustion engine efficiency is presently limited by the flame speed, which becomes slower as the fuel/air mixture ratio is lowered. Secondly, variations in the ignition delay time between cylinders and/or firings in the same cylinder reduce the engine efficiency because the timing of the combustion is rarely optimum. A method is needed which would ignite the mixture in a more repeatable manner and increase the effective flame speed (if possible) in the combustion chamber.

OBJECTS AND SUMMARY OF THE INVENTION

An object of this invention is to provide a method and means for igniting the fuel/air mixture in a combustion chamber with a plasma which extends much deeper into the chamber than can be obtained by spark ignition.

Still another object of the present invention is the provision of a more rapid and more repeatable fuel/air ignition system for an internal combustion engine system.

Yet another object of the invention is the provision of a novel and improved system for igniting the fuel/air mixture in an internal combustion engine.

The foregoing and other objects of the invention may be achieved in an arrangement wherein a large amount of energy is stored in a capacitor. The capacitor energy is permitted to be discharged into an igniter which is in each cylinder of an internal combustion engine, by utilizing a conventional spark, either as a switch to permit the capacitor to discharge into the igniter, or as a conventional spark within the cylinder to provide an initial amount of plasma, thereby enabling the capacitor to discharge. The high current discharge of the energy across a gap in the igniter produces hot plasma and a magnetic field. The resultant electro-magnetic force (current × magnetic field) accelerates the plasma deep into the combustion chamber and provides a superior method for igniting the mixture, inasmuch as the plasma extends a considerable distance into the mixture. The current discharge is at least 1000 amperes peak value and preferably is several thousands of amperes.

The novel features of the invention are set forth with particularity in the appended claims. The invention will best be understood from the following description when read in conjunction with the accompanying drawings.

DESCRIPTION OF THE PREFERRED EMBODIMENTS

Figure 1:
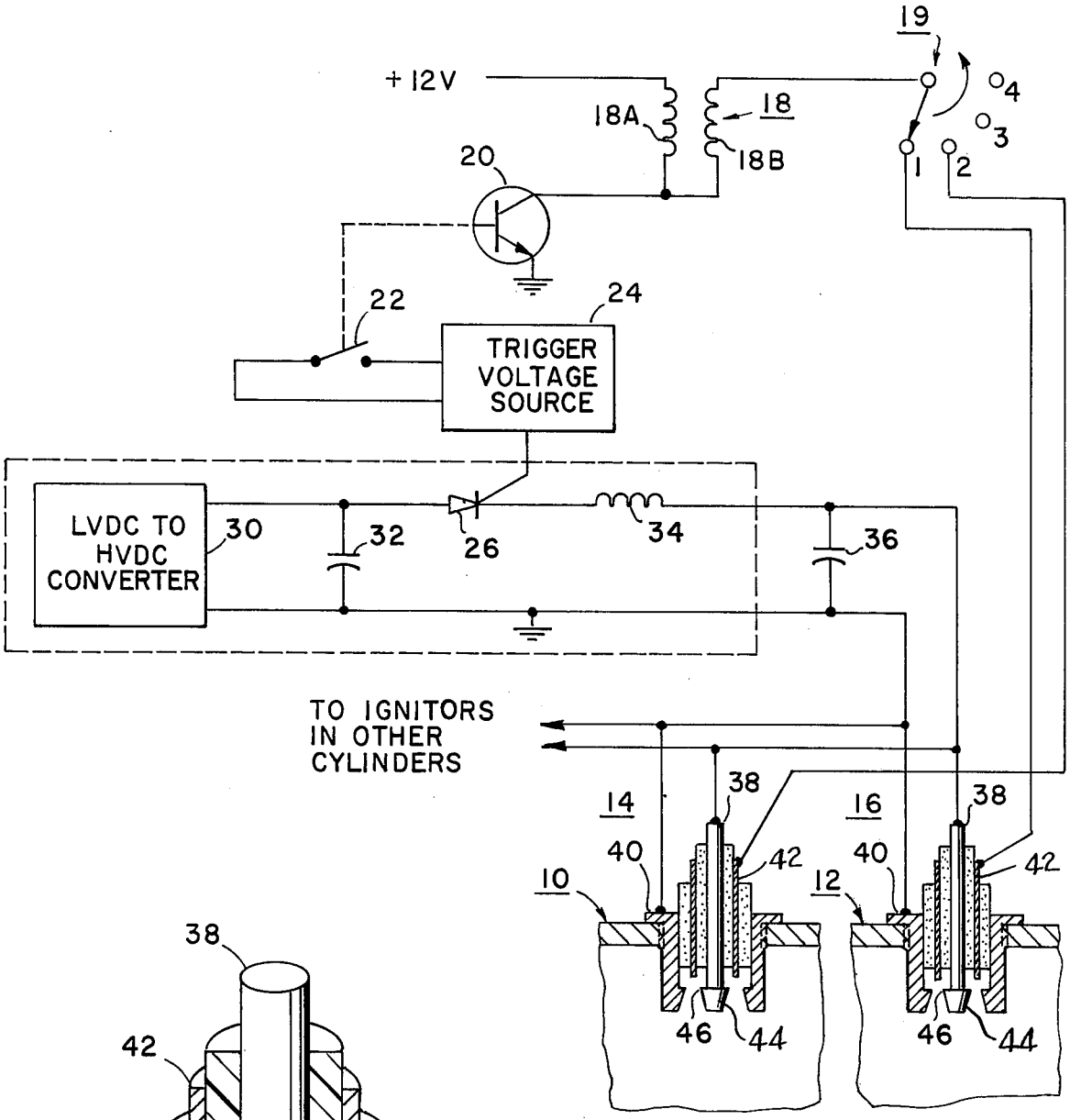
FIG. 1 is a schematic diagram of an arrangement for causing plasma ignition in an internal combustion engine, in accordance with this invention.
Figure 2:
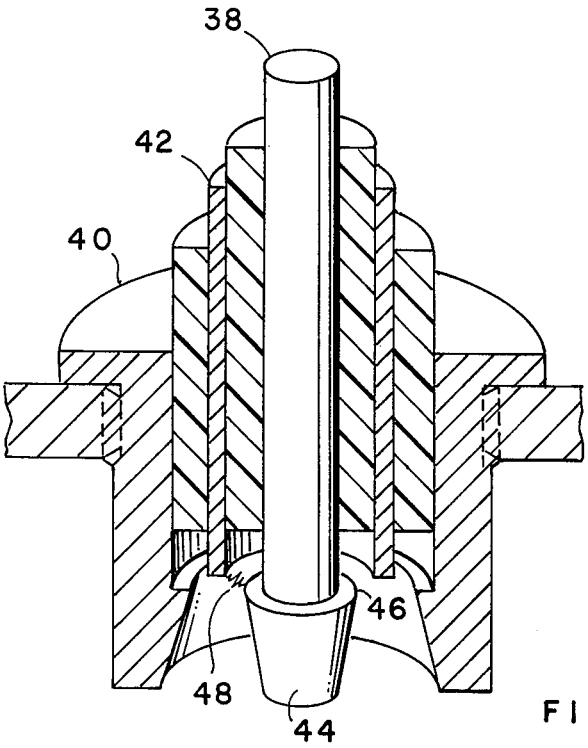
FIG. 2 is a cross-sectional view of an igniter in accordance with this invention.

Referring now to FIG. 1, there may be seen a schematic diagram of an embodiment of the invention. By way of example, portions of two of the cylinders, respectively 10, 12, of a multi-cylinder internal combustion engine are shown. An igniter respectively, 14, 16, is inserted in each of the cylinders, in place of the usual spark plug. An enlarged cross-sectional drawing of an igniter is shown in FIG. 2 and it will be referred to in accordance with the description of FIG. 1.

The conventional spark coil 18 has one end of its primary 18A, connected to a suitable voltage source, here designated as +12V, and the other end of the primary together with one end of the secondary 18B, connected together and to a switching transistor 20. The transistor is enabled to connect the common point to ground when the points in the distributor, here represented by a switch 22, make a connection to a trigger voltage source 24. The trigger voltage source simultaneously applies a voltage to both the transistor 20 to enable it to conduct current through the primary winding, and to the gate electrode of a silicone controlled rectifier (SCR), 26.

The secondary winding 18B of the spark coil is connected in the usual manner to the rotor of a conventional distributor 19, whereby the high voltage, generated when transistor 20 is energized, may be applied through one of the distributor contacts, designated by the numerals, 1, 2, 3, 4 to the igniter connected to that contact.

A converter 30 converts the low voltage of the battery to a high voltage, on the order of 2000 volts, by way of example. The output of the converter is used to charge a capacitor 32, which can have a capacity on the order of 100 uF. The SCR 26 is serially connected to one end of the capacitor 32. The SCR output is connected to one end of a choke coil 34. The other end of the choke coil is connected to a capacitor 36 having a value on the order of 1 uF. This capacitor is also connected across the two output lines from the converter 30 which, together with the SCR and choke coil 34, serve to rectify the output from the capacitor 32 and to insure that there is no current feedback. This is a standard circuit known as a resonance charging circuit. The two output lines across which capacitors 32 and 36 are connected, are respectively connected to a center electrode 38 and an outside electrode 40 of the igniter. The igniter outside electrode is connected to ground.

The high voltage lead from the distributor is connected to an intermediate electrode 42. The end of the center electrode 38, which is within the piston, has a cap 44 at the end thereof with a sharp edge 46 which is opposite the termination of the intermediate electrode 42. It should be noted that the electrodes 40, 42 and 38 are spaced from one another by insulating material.

In operation, using the arrangement shown in FIG. 1 as an example, when the distributor points close during the operation of the engine, the spark coil will apply a high voltage to terminal 1 of the distributor, whereby this voltage is applied to the intermediate electrode 42 of the first igniter. This high voltage causes a spark 48 to be created between the edge 46 of the cap 44 and the intermediate electrode 42, as shown in FIG. 2. The spark causes the fuel/air mixture between these electrodes to break down, so that a small volume of plasma is produced between the electrodes to which the capacitor is connected. The spark is established between the edge 46 of the cap 44 and the internal edge of the intermediate electrode 42.

Figure 3A:
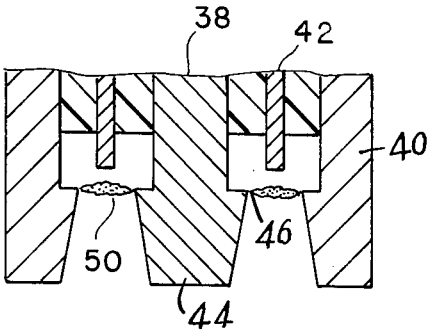
FIGS. 3A and 3B and 3C are partial cross-sectional views illustrating how the plasma progresses into a combustion chamber, once it is formed.
Figure 3B:
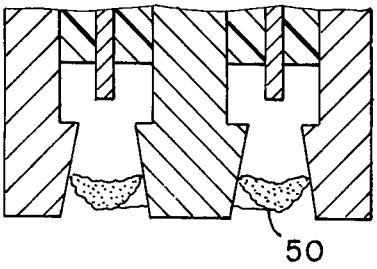
Figure 3C:
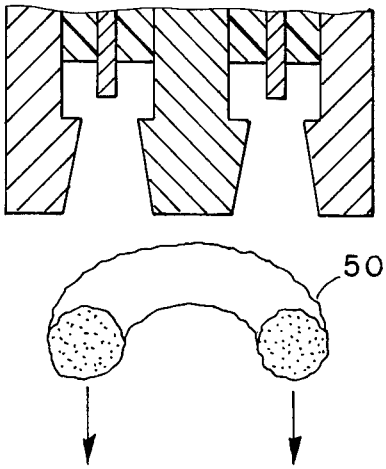

Referring now to FIGS. 3A, 3B and 3C, there may be seen in cross-section, an end of an igniter. The plasma formed by the discharge of the spark across conductors 42 and 44, extends between the inner and outer electrodes 44 and 40. The voltage from the trigger voltage source enables the SCR 26 to conduct, which enables the capacitor 32 to discharge into the igniter and establish a plasma, such as is represented by 50, between the inner and outer electrodes. This plasma is in the form of a toroidal ring. As the capacitor continues to discharge, the rapid increase in current enlarges the plasma. The high current discharge which should be at least 1000 amperes produces a large magnetic field, and the resultant ($J \times B$ or current $\times$ magnetic field) force accelerates the plasma, as shown in FIGS. 3B and 3C along the electrodes, and eventually the plasma detaches from the electrodes and moves into the combustion chamber at very high (supersonic) velocity, thus extending the source of ignition deep into the fuel/air mixture in the combustion chamber.

The high current discharge may be supplied by a single capacitor for all combustion chambers or by one capacitor for each chamber, and the igniter firing is instigated by a spark from the distributor as shown. The discharge current for normal spark plug operation in an internal combustion engine is on the order of 10 amperes.

Figure 4:
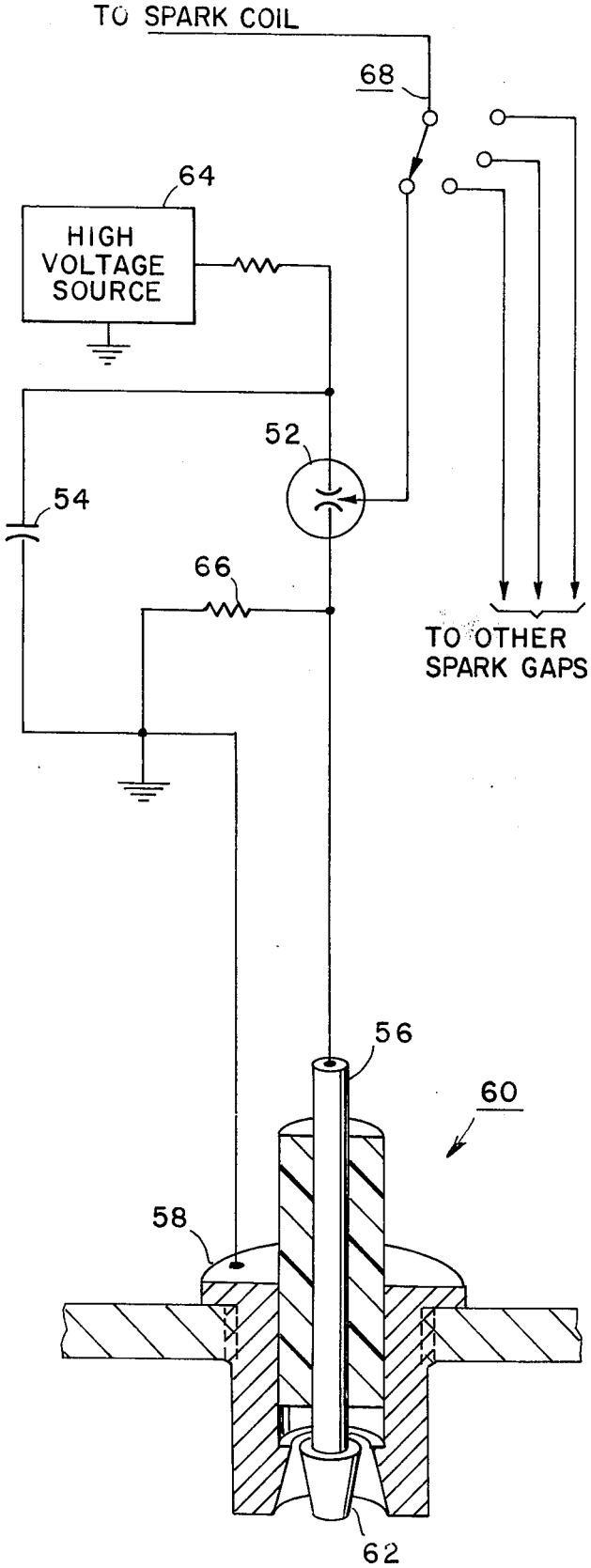
FIG. 4 is a schematic drawing of another embodiment of the invention.

FIG. 4 illustrates another embodiment of the invention. Here, no "priming spark" is used to initiate a discharge within a cylinder of the engine. An external spark gap 52 is used as a switch to enable the discharge of a capacitor 54, between the inner electrode 56 and outer electrode 58, of an igniter 60. The intermediate electrode is omitted from the igniter in this embodiment of the invention. The inner electrode 56 of the igniter has a cap 62, similar to the one described and shown previously.

Capacitor 54 is charged up from a high voltage source 64, which can be on the order of 30 kilo volts. The high voltage source may be connected through a resonant charging circuit or, as shown through a high voltage resistor, such as 10 megohms by way of example, to the spark gap 52. The spark gap may be any of the known spark gap switching devices which essentially comprise an envelope filled with an inert gas, and having a pair of spaced electrodes with an igniter electrode positioned therebetween.

When the distributor 66 applies a high voltage to the igniter electrode of the spark gap, a spark is created and the spark gap enables the capacitor 54, to which it is connected, to discharge between the inner and outer electrodes, respectively 56, 58 of the igniter, whereby a plasma ring is created within the chamber and serves to ignite the fuel/air mixture.

A resistor 66, which is connected between the inner and outer electrodes of the igniter, is used as a current path to initiate the spark gap breakdown and also serves to prevent any high voltage feedback by shunting the igniter. As soon as the voltage being supplied from the capacitor 54 drops below the level of voltage which is required to maintain the spark in the spark gap 52, it terminates the discharge. Capacitor 54, by way of example, may have a value of 2200 pF, and resistor 66 a value of 10 K ohms.

The distributor 68 successively applies the high voltage from the spark coil to other spark gaps 52, there being one for each chamber. Here again, a single capacitor may be used for all chambers, or the arrangement shown in FIG. 4 may be duplicated for each chamber.

Figure 5:
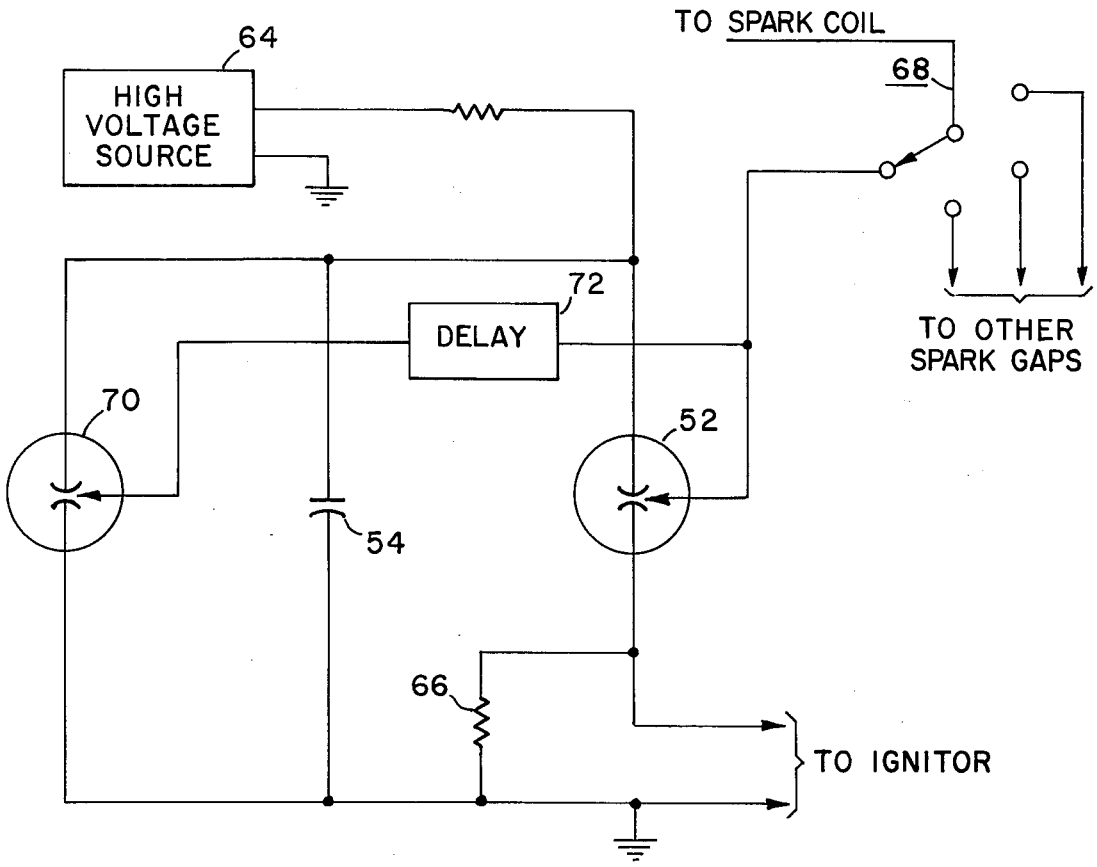
FIG. 5 is a partial schematic drawing of another embodiment of the invention.

FIG. 5 is a fragmentary circuit diagram of FIG. 4 which shows another and preferred embodiment of the invention. The circuit is similar to that of FIG. 4, except that an additional spark gap (70) has been placed in parallel with capacitor 54. This second spark gap is fired at a time which is delayed, by delay circuit 72, after the time the first spark gap 52 has discharged, to act as a short circuit or "crowbar" on capacitor 54. This results in the removal of the capacitor 54 from the circuit during the remainder of the discharge period. As a result, the characteristics of the discharge are changed from a ringing (underdamped) L-R-C discharge to a D.C. pulse.

Figure 6:
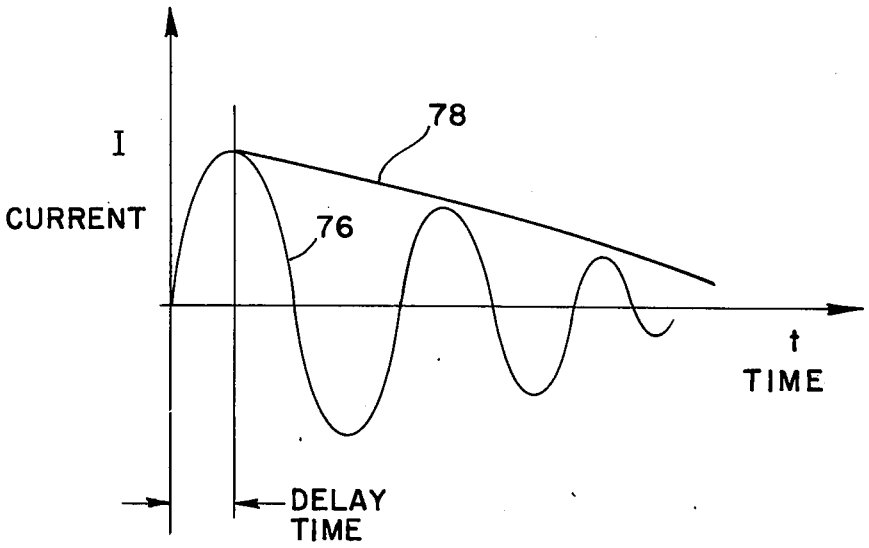
FIG. 6 is a wave form drawing shown to illustrate the operation of the circuit of FIG. 5.

As shown in curve 76, FIG. 6, the delay time of circuit 72 is selected to enable substantially peak discharge current to be reached after spark gap 52 is discharged, whereby the following current discharge will follow approximately a straight line path as shown by curve 78 instead of following curve 76.

There has accordingly been shown and described here a useful and improved arrangement for igniting the air/fuel mixture in each chamber of an internal combustion engine wherein the plasma which ignites the mixture is driven at a high velocity deep into the chamber by the electromagnetic force created by the high current discharge.

We claim:

1. A system for igniting the air/fuel mixture introduced into each of the chambers of an internal combustion engine comprising a pair of substantially parallel electrodes spaced with a gap of substantial depth within each of said chambers, said gap being open to receive an air/fuel mixture, an intermediate spark electrode between said pair of spaced electrodes, a high voltage, high current storage capacitor voltage means for storing a high electrical charge in said capacitor, means for applying a spark voltage between said spark electrode and one of said pair of igniter electrodes, means for enabling an electrical current discharge between said pair of spaced electrodes with an amplitude which establishes a plasma between the electrodes, and which establishes electro-magnetic forces due to current from said capacitor through said spaced electrodes and plasma developing a magnetic field which drives the plasma in a direction parallel to said spaced electrodes deep into the combustion chamber at a supersonic velocity.

2. A system as recited in claim 1 wherein said electrical current which is discharged has a peak value of 1000 amperes or above.

3. A system as recited in claim 1 wherein said means for establishing a current discharge across said igniter spaced electrode comprises means for connecting said capacitor across the spaced electrodes of said igniter, and means for enabling the timed discharge of said capacitor across the space between the spaced electrodes of said igniter.

4. A system as recited in claim 3 wherein said means for enabling the timed discharge of said capacitor comprises a source of voltage, means for applying voltage from said source to said spark electrode for establishing a spark and plasma within said chamber of said internal combustion engine.

5. A system as recited in claim 1 wherein said timing means for enabling said capacitor to discharge across the space between said pair of spaced electrodes comprises a triggerable spark gap means connected between one of said pair of spaced electrodes, and means for enabling a timed discharge of said triggerable spark gap means for enabling current from said capacitor to flow therethrough.

6. A system for igniting the air/fuel mixture introduced into each of the chambers of an internal combustion engine comprising a pair of substantially parallel electrodes spaced with a gap of substantial depth within each of said chambers, said gap being open to receive an air/fuel mixture, a high voltage high current storage capacitor, voltage means for storing a high electrical charge in said capacitor, means for enabling an initial electrical current discharge between said spaced electrodes with an amplitude which establishes a plasma between the electrodes, and which establishes electromagnetic forces due to current from said capacitor through said electrodes and plasma developing a magnetic field which drives the plasma in a direction parallel to said electrodes deep into the combustion chamber at a supersonic velocity, wherein said timing means for enabling said capacitor to discharge across the space between said spaced electrodes comprises a triggerable spark gap means connected between one terminal of said capacitor and one of said spaced electrodes, and means for enabling a timed discharge of said triggerable spark gap means for enabling current from said capacitor to flow therethrough, wherein there is included an additional triggerable spark gap means connected across said triggerable spark gap means, and means for enabling discharge of said additional triggerable spark gap means at an interval after discharge of said triggerable spark gap means to prevent a ringing discharge by said triggerable spark gap means.

7. In an internal combustion engine, means for igniting the fuel/air mixture in the combustion chambers of that engine comprising an igniter for each of said combustion chambers, each igniter having a pair of substantially parallel electrodes spaced with a gap of substantial depth, said electrodes being accessible from without each combustion chamber, and said gap being open to receive an air/fuel mixture, means for storing electrical energy which is sufficiently high that when it is discharged across the spaced electrodes of said igniter it generates plasma and a high current through said electrodes to produce an electromagnetic force that propels said plasma in a direction parallel to said electrodes at a supersonic velocity deep into said chamber, means coupling said source of energy to the spaced electrodes of said igniter, and timed spark discharge means for enabling energy from said storage means to be discharged across said spaced electrodes of said igniter, wherein said timed spark discharge means is connected externally to a combustion chamber and between an igniter and said storage means.

8. In an internal combustion engine, means for igniting the fuel/air mixture in the combustion chambers of that engine comprising an igniter for each of said combustion chambers, each igniter having a pair of substantially parallel electrodes spaced with a gap of substantial depth, said electrodes being accessible from without each combustion chamber, and said gap being open to receive an air/fuel mixture, means for storing electrical energy which is sufficiently high that when it is discharged across the spaced electrodes of said igniter it generates plasma and a high current through said electrodes to produce an electromagnetic force that propels said plasma in a direction parallel to said electrodes at a supersonic velocity deep into said chamber, means coupling said source of energy to the spaced electrodes of said igniter, and time spark discharge means for enabling energy from said storage means to be discharged across said spaced electrodes of said igniter, wherein said timed spark discharge means comprises an auxilliary electrode positioned between said igniter pair of spaced electrodes.

* * * * *